United States Patent [19]

Goldberg et al.

[11] 4,244,144

[45] Jan. 13, 1981

[54] TOY MOTOR VEHICLE

[75] Inventors: Benjamin L. Goldberg, Chicago; Burton C. Meyer, Downers Grove, both of Ill.

[73] Assignee: Marvin Glass & Associates, Chicago, Ill.

[21] Appl. No.: 119,822

[22] Filed: Feb. 8, 1980

[51] Int. Cl.[3] ..... A63H 11/10

[52] U.S. Cl. ..... 46/202; 46/222; 46/116

[58] Field of Search ..... 46/201, 202, 221, 206, 46/106, 222, 223, 219, 111, 112, 116

[56] References Cited

U.S. PATENT DOCUMENTS

| | | | |
|---|---|---|---|
| 1,361,584 | 12/1920 | Howard | 46/201 |
| 2,621,098 | 12/1952 | Ford et al. | 46/204 X |
| 2,775,062 | 12/1956 | Gibson, Jr. et al. | 46/206 X |
| 2,862,330 | 12/1958 | Malsed | 46/201 X |
| 3,081,106 | 3/1963 | Budd | 301/63 PW X |
| 3,710,509 | 1/1973 | Spiegel | 46/202 X |
| 4,027,421 | 6/1977 | Allen | 46/201 X |

*Primary Examiner*—Robert Peshock

*Assistant Examiner*—Mickey Yu

*Attorney, Agent, or Firm*—Mason, Kolehmainen, Rathburn & Wyss

[57] ABSTRACT

A toy motor vehicle includes a body with a front end section, a read end section and an intermediate section for slidably interconnecting the front and rear ends for movement between a retracted, adjacent, position and an expanded, spaced apart, position. Wheels are provided on the end sections for supporting the vehicle to roll over a playing surface and a manually controlled drive element is provided for selectively moving the front and rear end sections toward and away from each other between retracted and expanded positions. The intermediate section is provided with a number of sockets of distinct shape and playing pieces of matching distinct shapes in the form of animated characters adapted to be placed in particular sockets of the same shape for exposure when the front and rear end sections are moved apart to the expanded position. In the expanded position, a step is automatically extended and the step is automatically retracted when the front and rear end sections are moved back together to the retracted position.

18 Claims, 8 Drawing Figures

6
6
10
12
14
14a
14b
16
16a
16b
18
20
22
24
26
28
30
32
34
36
38
38a
40
40a
40b
40c
42
44
46
48
50
52
54
56
58
60
72
72a
74
76
76a

TOY MOTOR VEHICLE

BACKGROUND OF THE INVENTION

1. Field of the Invention

The present invention relates to toy motor vehicles and more particularly to a toy motor vehicle adapted to change shape or form and especially well suited for play and use by young children.

2. Brief Description of the Prior Art

A wide variety of toy motor vehicles have been developed for young children and the like. These types of toy provide many hours of enjoyment during play.

OBJECTS OF THE INVENTION

It is an object of the invention to provide a new and improved toy motor vehicle of the character described and more particularly a toy vehicle especially well adapted and suitable for play by young children of tender years.

Another object of the present invention is to provide a new and improved toy motor vehicle of the character described having front and rear end sections interconnected to move between a retracted position and an expanded position exposing an interior section thereof.

Still another object of the present invention is to provide a new and improved retractable and expandible motor vehicle toy in the form of a bus having manually operable control means for moving the front and rear end sections toward and away from one another as desired.

Another object of the present invention is to provide a new and improved expandible toy motor vehicle of the character described having an intermediate section which is provided with sockets for receiving playing pieces in the form of animated characters that are exposed for viewing when the front and rear end sections are moved apart into an expanded or elongated position.

Still another object of the present invention is to provide a new and improved expandible toy motor vehicle having a pair of entry steps carried on an intermediate section, which steps are automatically extended whenever the front and rear end sections of the vehicle are moved apart into the expanded position.

Another object of the present invention is to provide a new and improved toy motor vehicle of the character described including automatic camming means for retracting the extended steps when the front and rear end sections are moved back together toward one another.

Yet another object of the present invention is to provide a new and improved toy motor vehicle or bus of the character described which is neat and pleasing in appearance, fun to play with and which is economical to construct on a mass production basis.

SUMMARY OF THE INVENTION

The foregoing and other objects and advantages of the present invention are accomplished in a new and improved toy motor vehicle by way of representation and not limitation which comprises a body having a front end section, a rear end section and an intermediate section for interconnecting the front and rear ends for sliding movement between a retracted or compact position and an expanded or extended position wherein the front and rear end sections are spaced apart to expose a mid-portion of the intermediate section. Wheels are provided for supporting the respective end sections so that the vehicle may roll freely over a playing surface and a manually operable control system is provided for selectively moving the front and rear end sections toward and away from each other to expand or contract the length of the vehicle. In a compact condition, the vehicle appears as a van or short vehicle and in the expanded condition, the vehicle appears as an open air excursion vehicle or bus. The intermediate section is provided with sockets for receiving animated playing pieces which may be selectively placed therein and manually retracted as desired during play. The pieces are exposed to view when the front and rear end sections of the vehicle are moved apart to the expanded position. The intermediate body section is provided with an automatically extending step which pivots laterally outwardly whenever the front and rear end sections are moved apart into the expanded condition. A cam system is provided for automatically retracting the steps into a recess in the intermediate body section when the front and rear end sections of the vehicle are moved back together to the retracted or compact position.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Referring now more particularly to the drawings therein is illustrated a new and improved toy motor vehicle 10 constructed in accordance with the features of the present invention and provided with a shape and dress or decoration generally resembling a compact or short bus or van in one condition and an expanded open air type excursion or sightseeing bus in another condition. The vehicle includes a body having a rear end section or shell 12, an intermediate section 14 and a front end section or shell 16 all of which are preferably formed of molded plastic material although the intermediate section 14 may be formed of wood or other solid material if desired.

Figure 1:
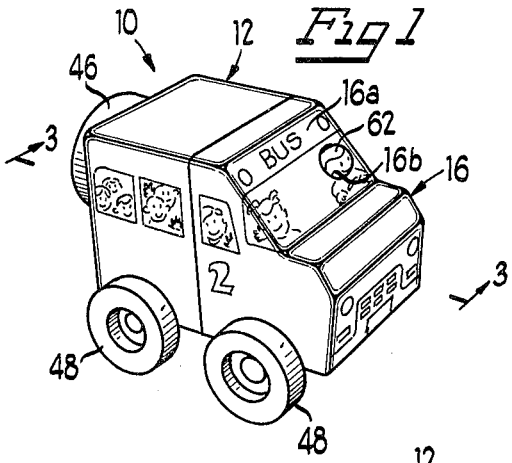
FIG. 1 is a perspective view of a new and improved toy motor vehicle constructed in accordance with the features of the present invention and shown with the front and rear end sections together in a retracted condition of the vehicle body.
Figure 2:
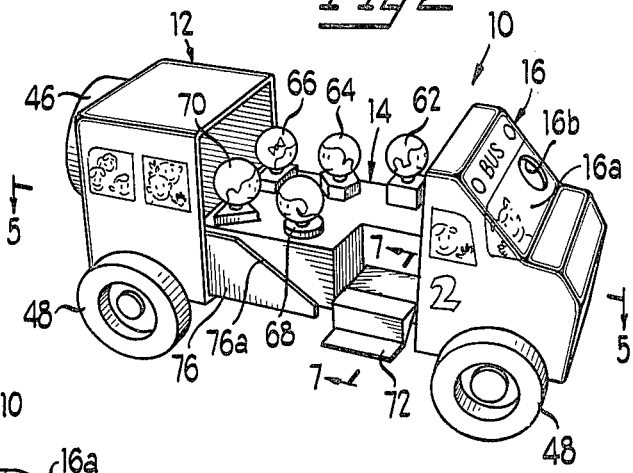
FIG. 2 is a perspective view of the vehicle shown with the front and rear end sections spaced apart in an expanded condition of the vehicle body with an intermediate section exposed and a step extended laterally outwardly thereof.

The body sections are interconnected for relative sliding movement along a longitudinal center axis of the vehicle so that the vehicle may take the form of a short, compact or retracted van-like closed body vehicle as shown in FIG. 1 or an expanded, longitudinally extended, open air type sightseeing or excursion vehicle as shown in FIG. 2. Slidable engagement between the intermediate body section 14 and the rear end shell 16 is provided by a first, inner pair of downwardly extending guide rails 18 formed on the bottom of the intermediate section on opposite sides of the centerline. These rails have a transverse cross section of angular shape so that each rail is adapted to slidably engage a longitudinally extending rail 20 on the upper surface of a bottom wall 22 of the front end section 16.

Slidable interconnection between the intermediate section and the rear end section or shell 12 is provided by a second pair of outer depending rails 24 projecting downwardly from the bottom of the intermediate section and spaced outwardly of the rails 18 of the inner pair. The outer rails 24 are slidably interfitted with respective rails 26 of a pair of rails of angular shaped transverse cross section extending upwardly from a bottom wall 28 of the rear end section. Interacting engagement between the pairs of rails 18 and 20 provide for continuous coaxial alignment of the intermediate section 14 and front end section 16 during longitudinal relative movement therebetween. Interfitting engagement between the rails 24 of the intermediate section and the rails 26 on the rear end section 12 maintain a continuous coaxial sliding relation between the sections during relative longitudinal sliding movement therebetween.

Figure 3:
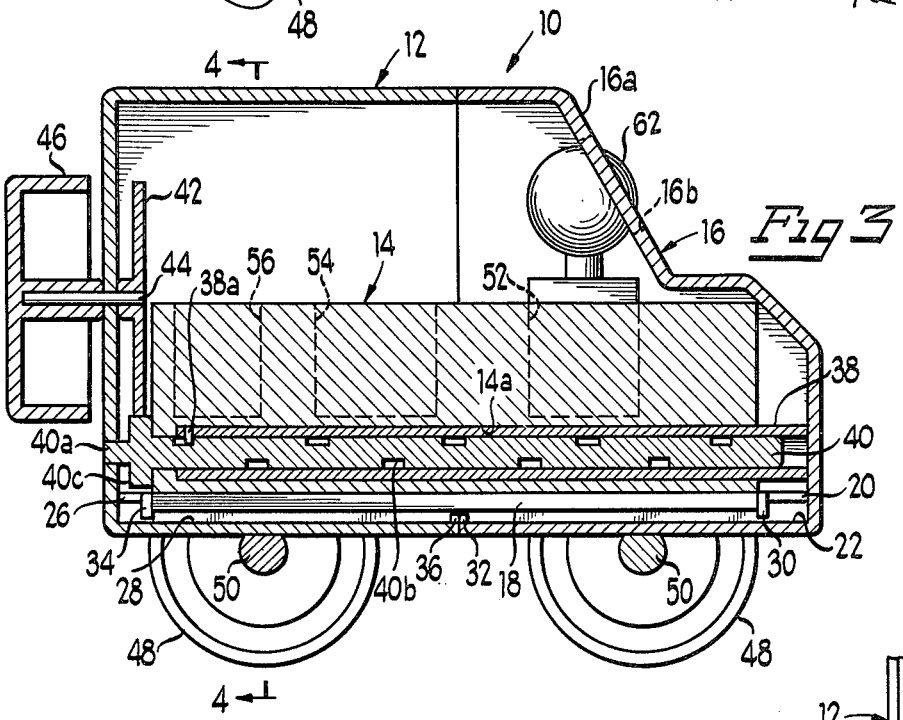
FIG. 3 is a longitudinal, vertical cross-sectional view taken substantially along lines 3—3 of FIG. 1.

As indicated in FIGS. 1 and 3, the rear and front end sections 12 and 16 are formed with open, inner ends which face and touch one another in closely fitted, adjacent, abutting relation when the vehicle body is in a compact or retracted condition and when the vehicle body is subsequently expanded to the condition of FIGS. 2, 5 and 6, the facing inner ends of the end sections are moved to a spaced apart relation so that the upper and side surfaces of the intermediate section 14 is fully exposed.

In order to limit the amount of movement so that the sections 12, 14 and 16 do not become disengaged, the forward end of the intermediate section 14 is provided with a pair of stop elements 30 depending downwardly thereof to engage stop elements 32 provided on the open end of the bottom wall 22 of the frong section 16. Another pair of stops 34 are provided on the rear end of the intermediate section 14 adapted to engage stops 36 provided on the inner open end of the bottom wall 28 of the rear section 12. Referring to FIG. 6, engagement between the respective stops 30 and 32 on the one hand and between the stops 34 and 36 on the other hand, is effective to positively limit the amount of longitudinal expansion permitted between the body sections 12, 14 and 16 when the toy vehicle 10 is in the expanded condition as shown.

Figure 4:
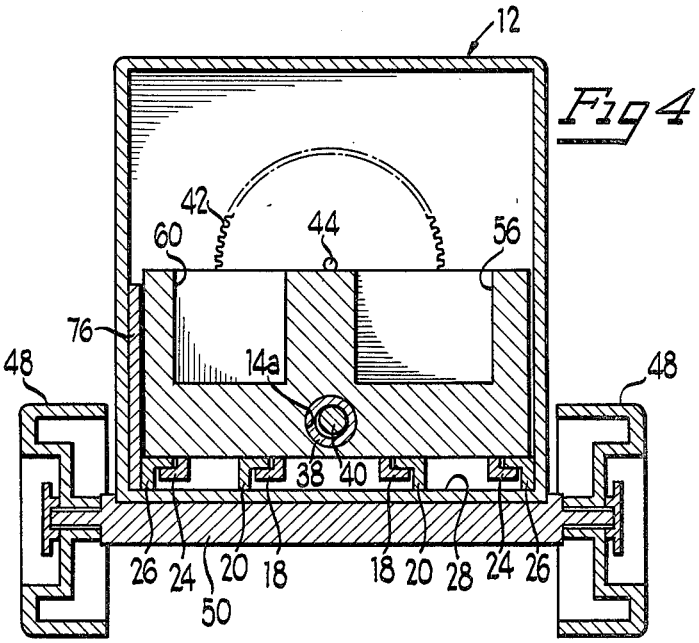
FIG. 4 is a transverse, cross-sectional view taken substantially along lines 4—4 of FIG. 3.
Figures 5, 6:
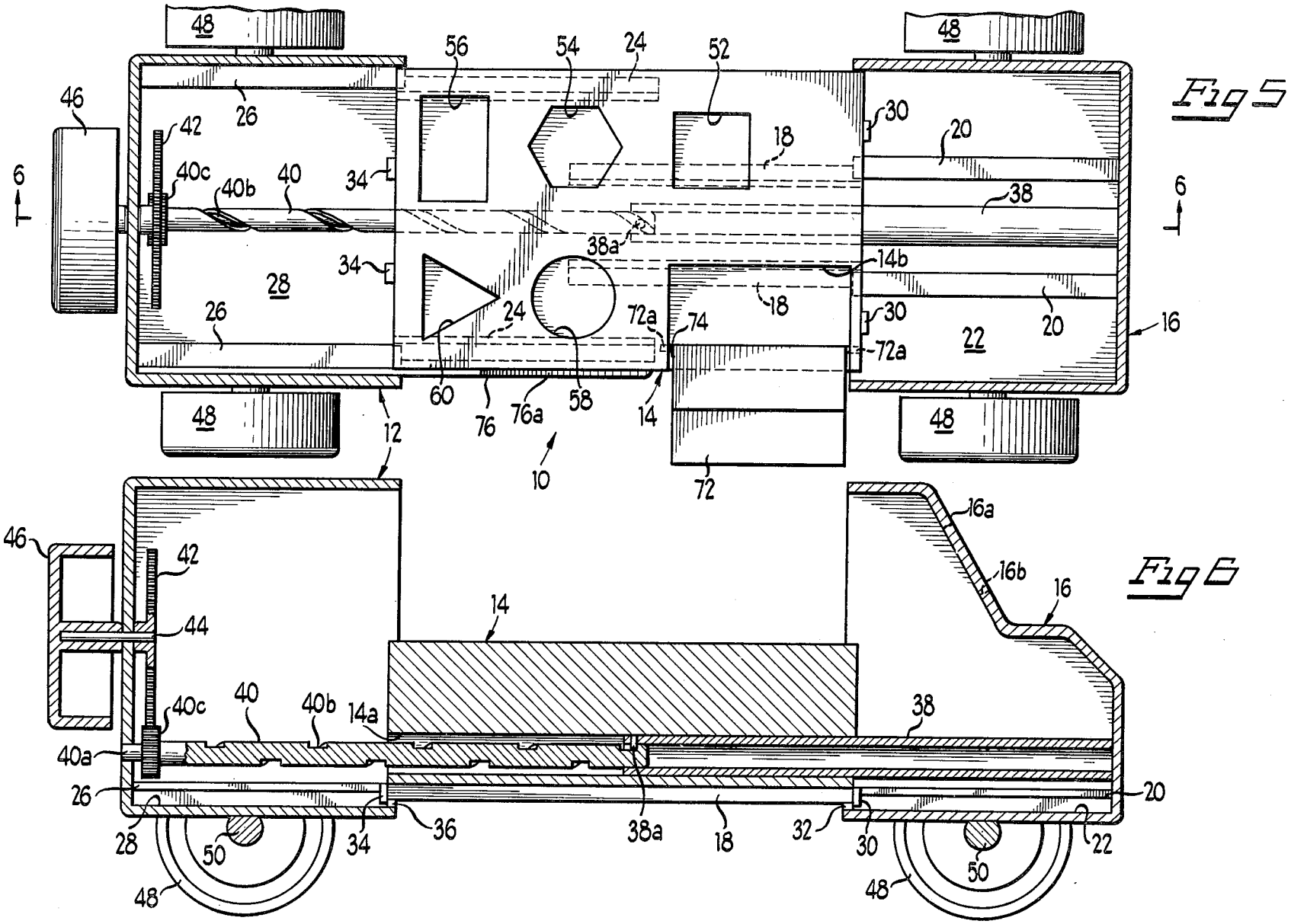
FIG. 5 is a longitudinally extending, horizontal cross-sectional view taken substantially along lines 5—5 of FIG. 2.
FIG. 6 is a longitudinally extending, vertical cross-sectional view taken substantially along lines 6—6 of FIG. 5.

In order to selectively control the relation between the body sections 12, 14 and 16 as desired, the front end section 16 is provided with a rearwardly extending hollow tube 38 joined to a front wall thereof and extending rearwardly and open at the rear end in order to receive an elongated, spirally threaded, drive screw 40 having a rear end **40*a* journalled in an opening formed in the rear wall of the rear end section 12 as shown in FIGS. 3 and 6. The screw member 40 is formed with a helical groove 40*b* spiralled around the length thereof and a radial follower pin 38*a* on the rearwardly facing end of the tube 38 is adapted to be drivingly engaged by the side walls of the groove of the spiral thread for moving the front end section 16 toward or away from the rear end section 12 depending upon which direction the drive screw 40 is rotated. As illustrated in FIGS. 3, 4 and 6, the body of the intermediate section 14 is formed with an elongated longitudinally extending bore 14*a* through which the screw member 40 and the tube 38** are longitudinally received.

The drive screw 40 is selectively rotated by an integral gear portion **40*c* thereon adjacent the rear end 40*a* and drivingly engaged by a gear wheel 42 of larger diameter carried on an idler shaft 44 extending through an opening in the rear wall of the rear end section 12 above the end of the drive screw shaft 40*a*. An outer end portion of the idler shaft 44 supports a rotatable hand wheel 46 which is decorated and shaped to appear as a spare tire on the rear of the vehicle. Manual rotation of the hand wheel is effective to change the configuration or form of the vehicle body between the compact or retracted condition of FIG. 1 and the expanded or open condition of FIG. 2**.

The rear end section 12 and the front end section 16 are provided with a pair of support wheels 48 mounted for rotation on outer end portion of transverse axles 50 which are secured to the underside or integrally joined with the bottom walls 22 and 28 of the respective front and rear body sections. No wheel support is provided for the intermediate body section 14 which serves to bridge the space between the facing inner ends of the front and rear end shells 16 and 12 when the vehicle is in the expanded or open condition as shown in FIG. 2.

In accordance with the present invention, the intermediate body section 14 is formed with a plurality of recesses in the upper portion thereof opening onto a top surface and each recess or well has a uniquely distinct and different cross-sectional shape as illustrated best in FIG. 5. The respective wells or sockets are designated by the reference numerals 52, 54, 56, 58 and 60, and for each of the sockets, there is provided a respective animated character 62, 64, 66, 68 and 70 having a base portion formed with a transverse cross-section shaped to fit only within a particular matching socket of similar distinct cross-sectional shape. As illustrated, the animated characters or playing pieces may be manually inserted into their respective sockets or recesses and may be withdrawn therefrom at any time during play. Each animated character is provided with a spherical head portion having a decorative face thereon to represent a person sitting in the midportion of the vehicle body.

In accordance with a feature of the present invention, the forward end section 16 is formed with an upwardly and rearwardly sloping front end wall segment **16*a* having a circular opening 16*b* defined therein and adapted to receive a forwardly and upwardly facing segment of the spherical head of the animated playing piece or character 62, when the character is seated in the recess 52 in the intermediate section 14 and the vehicle is in the compact or retracted condition as shown in FIGS. 1 and 3**.

Figure 7:
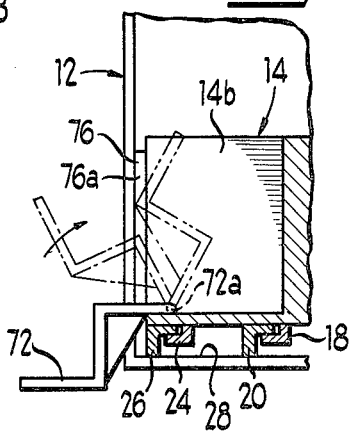
FIG. 7 is a fragmentary, transverse, cross-sectional view taken substantially along lines 7—7 of FIG. 2.
Figure 8:
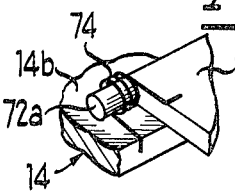
FIG. 8 is a greatly enlarged, fragmentary, perspective view illustrating a biasing system for extending the steps outwardly from the intermediate section of the motor vehicle.

In accordance with another feature of the present invention, the intermediate body section 14 is formed with a rectangular recess **14*b* adjacent a forward end portion on one side and an entrance step element 72 is mounted for pivotal movement about a longitudinal axis extending coaxially of a pair of integral support pins 72***a* at the forward and rearward ends as shown. The step element is normally biased towards a laterally outwardly and downwardly extending, pickup or loading position as shown in FIGS. 2 and 7 by a coil spring 74 (FIG. 8) having several turns coiled around one of the support pins 72*a* and a pair of radial tang portions connected to engage respective surfaces on the body section 14 and the step element 72 as illustrated.

In order to automatically retract the step element 72 into the recess 14*b* whenever the form of the toy vehicle is changed from the expanded condition of FIG. 2 to the retracted condition of FIG. 1, a cam element 76 having a downwardly and forwardly sloping front edge cam surface 76*a* is provided on the righthand wall of the rear end section 12 to extend outwardly from the inner open end thereof along the step side of the intermediate section 14. As the body section 14 is telescoped rearwardly towards the rear end shell 12, the cam surface 76*a* engages gussets on the underside of the step element 72 causing the step to pivot in a clockwise direction as shown in FIG. 7 toward the closed or retracted position as indicated by the several phantom views shown in dotted lines. The step 72 is fully contained within the relatively large rectangular recess 14*b* by the time the rearward edge of the recess is positioned adjacent and ready to enter the inner open end of the rear end body shell 12. Subsequently, when the body of toy vehicle 10 is expanded in length and the step element 72 clears the forward end of the cam surface 76*a*, the spring 74 is then effected to automatically open the step laterally outwardly of the intermediate body section into the pickup or ready position.

Although the present invention has been described with reference to a single illustrated embodiment thereof, it should be understood that numerous other modifications and embodiments can be devised by those skilled in the art that will fall within the spirit and scope of the principals of this invention.

What is claimed as new and desired to be secured by Letters Patent of the United States is:

1. A toy vehicle, comprising:

a body having a front end section, rear end section and an intermediate section for slidably interconnecting said front and rear end sections for movement between a retracted adjacent position and an expanded spaced apart position;

wheel means for supporting said end sections for rolling movement over a playing surface during play; and manually controllable drive means on said vehicle interconnecting said end sections for selectively moving said end sections toward and away from each other to adjust the length of said vehicle to vary on a continuous basis between a minimum length in said retracted position and a maximum length in said expanded position.

2. The toy vehicle of claim 1 wherein said sections include means for slidably interconnecting said respective sections for relative reciprocal sliding movement along a longitudinal axis of said vehicle.

3. The toy vehicle of claim 2 wherein said interconnecting means includes rail means for slidably interconnecting one section with rail means of an adjacent section.

4. The toy vehicle of claim 3 wherein said intermediate section includes a pair of said rail means for sliding interconnection with rail means on said front end section or said rear end section.

5. The toy vehicle of claim 3 or 4 wherein each of said rail means includes a pair of longitudinally extruding parallel rails mounted on a section for laterally interlocked engagement with the rails on a connected section.

6. The toy vehicle of claim 5 including stop means for limiting the extent of longitudinal travel between adjacent sections moving between said relative positions.

7. The toy vehicle of claim 1 wherein said drive means includes rotatable means mounted on one of said sections for driving elongated screw means extending between adjacent sections for moving the same in relative longitudinal sliding movement.

8. The toy vehicle of claim 7 wherein said rotatable means includes a wheel mounted for rotation on an end wall of said rear end section.

9. The toy vehicle of claim 7 wherein said screw means is fixed against axial translation on said one section and extends longitudinally into an adjacent section to drivingly engage the same.

10. The toy vehicle of claim 9 wherein said one section comprises said rear end section and said front end section includes a longitudinal tube for receiving said screw means and follower means for moving said tube means longitudinally of said screw means as said screw means is rotated.

11. The toy vehicle of claim 10 including a stop element for limiting the longitudinal relative movement of an end section outwardly away from said intermediate section.

12. The toy vehicle of claim 10 or 11 including a stop element for limiting the longitudinal movement of said intermediate section outwardly away from another end section.

13. A toy vehicle, comprising:

a body having a front end section, rear end section and in intermediate section for slidably interconnecting said front and rear end sections for movement between a retracted adjacent position and an expanded spaced apart position;

said end sections comprising convex hollow shells having open inner ends facing one another and adapted to open and close with respect to each other to selectively expose and enclose said intermediate section extending between said inner ends;

wheel means for supporting said end sections for rolling movement over a playing surface during play; and manually controllable drive means on said vehicle interconnecting said end sections for selectively moving said end sections toward and away from each other to adjust the length of said vehicle to vary on a continuous basis between a minimum length in said retracted position and a maximum length in said expanded position.

14. The toy vehicle of claim 13 wherein said intermediate section is formed with at least one socket in a body portion thereof adapted to receive and hold a removable animated playing piece placed therein.

15. The toy vehicle of claim 14 wherein said animated playing piece includes a head portion extending upwardly of said intermediate section when placed in said socket.

16. The toy vehicle of claim 14 wherein said front end section includes a wall having an opening therein for receiving said head portion to extend outwardly of said wall through said opening when said end sections are moved together to said retracted position.

17. The toy vehicle of claim 13 including a step means pivotally mounted along one side of said intermediate section and biased to extend laterally outwardly and downwardly thereof when said end sections are moved apart toward said expanded position.

18. The toy vehicle of claim 17 including cam means on one of said end sections for moving said step means toward a retracted position when said end sections are moved toward said retracted position.

* * * * *